US009102436B2

(12) United States Patent
Rajter, Jr.

(10) Patent No.: US 9,102,436 B2
(45) Date of Patent: Aug. 11, 2015

(54) FOLDING LOCKING END WALL ASSEMBLY FOR MERCHANDISE PACKAGE

(71) Applicant: Wynalda Litho, Inc., Belmont, MI (US)

(72) Inventor: Robert G. Rajter, Jr., Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

(21) Appl. No.: 14/083,345

(22) Filed: Nov. 18, 2013

(65) Prior Publication Data

US 2014/0138262 A1 May 22, 2014

Related U.S. Application Data

(60) Provisional application No. 61/727,699, filed on Nov. 17, 2012.

(51) Int. Cl.

| | |
|---|---|
| ***B65D 5/42*** | (2006.01) |
| ***B65D 5/10*** | (2006.01) |
| *B65D 5/02* | (2006.01) |

(52) U.S. Cl.

CPC ..... *B65D 5/103* (2013.01); *B65D 5/0209* (2013.01); *B65D 5/106* (2013.01); *B65D 5/4208* (2013.01); *B65D 5/0254* (2013.01); *B65D 2585/6885* (2013.01)

(58) Field of Classification Search

CPC ..... B65D 5/103; B65D 5/106; B65D 5/0209; B65D 5/0254; B65D 5/4208; B65D 2585/6885

See application file for complete search history.

(56) References Cited

U.S. PATENT DOCUMENTS

| | | | | |
|---|---|---|---|---|
| 2,591,882 | A * | 4/1952 | Shirley | 229/158 |
| 3,157,343 | A * | 11/1964 | Kendall | 229/115 |
| 3,190,440 | A * | 6/1965 | Palmer | 229/107 |
| 4,355,758 | A * | 10/1982 | Lavery | 229/117.18 |
| 4,457,431 | A * | 7/1984 | Lundquist et al. | 229/101.1 |
| 5,305,875 | A * | 4/1994 | Meyer | 206/45.25 |
| 7,690,509 | B2 * | 4/2010 | Herring et al. | 206/470 |
| 8,434,621 | B2 * | 5/2013 | Hun et al. | 206/471 |
| 2009/0236351 | A1 * | 9/2009 | Chu et al. | 220/751 |
| 2012/0111754 | A1 * | 5/2012 | Domerchie et al. | 206/470 |

FOREIGN PATENT DOCUMENTS

| | | | | |
|---|---|---|---|---|
| FR | 2627462 | A1 * | 9/1989 | B65D 5/103 |

* cited by examiner

*Primary Examiner* — Gary Elkins

(74) *Attorney, Agent, or Firm* — Zollinger & Burleson Ltd.

(57) ABSTRACT

A folding locking end wall assembly for a pillow pack is disclosed wherein the end wall is locked against opening forces created by the merchandise inside the packaging. In one exemplary configuration, the pillow pack is configured for automobile wiper blades and the disclosure is relevant to various other items of elongated merchandise that are relatively heavy for their size.

17 Claims, 3 Drawing Sheets

FOLDING LOCKING END WALL ASSEMBLY FOR MERCHANDISE PACKAGE

CROSS REFERENCE TO RELATED APPLICATIONS

This application claims the benefit of U.S. Provisional Patent application Ser. No. 61/727,699 filed Nov. 17, 2012; the disclosures of which are incorporated herein by reference.

BACKGROUND OF THE DISCLOSURE

1. Technical Field

The disclosure generally relates to merchandise packaging and, more particularly to a folding locking end wall assembly for an elongated container.

2. Background Information

Clamshell packaging, blister packaging, and pillow packaging are common packaging types having at least one wall of the packaging body formed from plastic. A pillow pack is a form of packaging with two opposed main walls that are curved away from each other and held in their curved configuration by the configuration of end walls. The overall appearance of the packaging is pillow-shaped thus garnering the name "pillow pack." When these pillow packs are used to store and display elongated items of merchandise, the retail establishments displaying the packaged merchandise like to hang the packages vertically which causes the merchandise to rest against an end wall of the pillow pack. In order to prevent the end wall from failing and allowing the merchandise to fall out of the packaging, the users of the these elongated pillow packs weld the end wall closed or use a heat seal to secure a locking tab to the body of the pillow pack or to join a pair of tabs. Automobile wiper blades provide an example of elongated items of merchandise that are packaged in this manner. Although the above-described solutions secure the package and prevent end wall failures, the added manufacturing steps consume time, the energy required to close the end wall adds cost, and shipping formed pillow packs prior to filling them requires excessive air to be shipped thus increasing cost.

SUMMARY OF THE DISCLOSURE

The disclosure provides a folding locking end wall assembly for a pillow pack wherein the end wall is locked against opening forces created by the merchandise inside the packaging. In one exemplary configuration, the pillow pack is configured for automobile wiper blades and the disclosure is relevant to various other items of elongated merchandise that are relatively heavy for their size.

The folding locking end wall assembly includes an end wall that defines a slot and maintains the pillow shape of the package. The assembly also includes a lock tab that folds over to snap into the slot wherein it holds the end wall substantially perpendicular to the main walls of the package while also supporting the end wall from a direction that opposes the opening forces from inside the package in a direction that is substantially opposite the direction of that force. The lock tab is disposed along the inner surface of the rear main wall and an outer end wall that includes a lock tab that is receives in the slot to lock the outer end wall to the inner end wall while simultaneously maintaining the pillow shape of the pillow pack.

BRIEF DESCRIPTION OF THE DRAWINGS

Similar numbers refer to similar parts throughout the specification.

DETAILED DESCRIPTION OF THE DISCLOSURE

Figure 1:
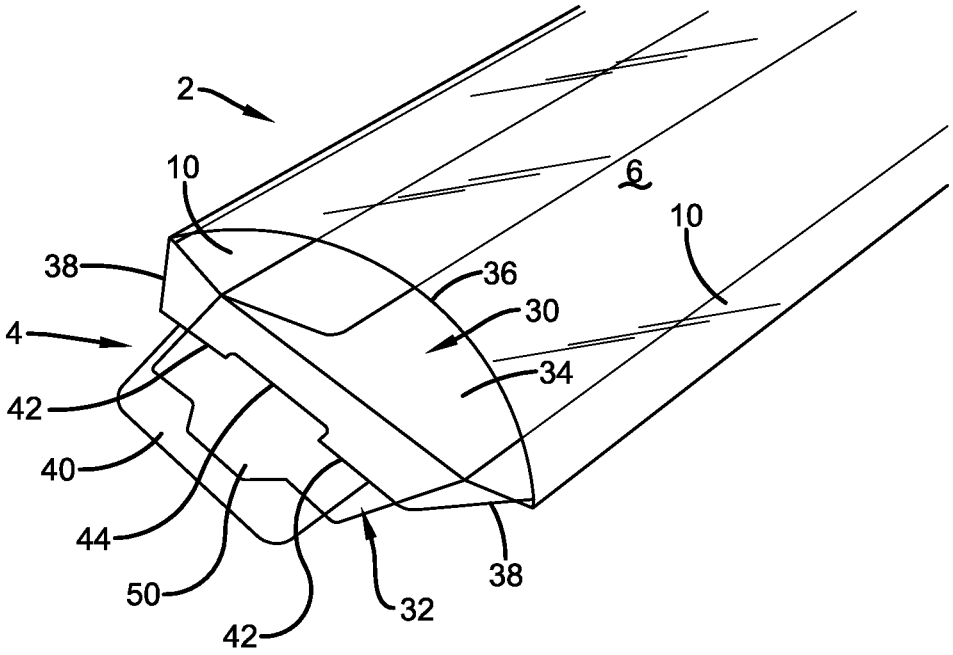
FIG. 1 is a perspective view of the folding locking end wall assembly of an exemplary pillow pack wherein the pillow pack and the end wall assembly are disassembled and substantially flat.

An exemplary configuration of a pillow pack is indicated generally by the numeral 2 in the accompany drawings. Pillow pack 2 has a folding locking end wall assembly 4 that secures the lower end of pillow pack 2 when pillow pack 2 is hung vertically for display the merchandise held within pillow pack 2. In this position, the merchandise pushes downwardly against folding locking end wall assembly 4 from the inside of pack 2 in a substantially vertical direction. Assembly 4 is configured to resist this force while also helping to hold the pillow shape of pack 2.

Pillow pack 2 generally includes a front main wall 6 that is curved with respect to a flat rear main wall 8 when pack 2 is assembled. A pair of intermediate walls 10 are disposed between front main wall 6 and rear main wall 8. Intermediate walls 10 allow pack 2 to be shipped flat and the erected to an assembled position wherein front main wall 6 is outwardly curved. A glue flap 12 extends from front main wall 6 and is adhered to the rear surface of main rear wall 8 when pack 2 is assembled.

When pack 2 is assembled, the upper end of main rear wall 8 extends beyond the upper end wall 14 of pack 2 and defines an opening 16 which is used to hang pack 2 from a hook on a display. A tab 18 is connected to the upper end of main rear wall 8 by a first living hinge 20 so that tab 18 can be folded over the upper end of main rear wall 8. Tab 18 defines its own hang opening 22 and a slot 24 spaced from opening 22. Slot 24 receives a tongue 26 which extends from upper end wall 14 when upper end wall 14 is folded down about a second living hinge 28 to an assembled position. Tongue 26 passes through both slot 24 and opening 16 to secure upper end wall 14 in place.

Folding locking end wall assembly 4 generally includes a lower end wall 30 and a locking tab 32 which lock together when assembled. Lower end wall 30 includes a first portion 34 that forms the lower end of pack 2 and helps to maintain the curved shape of front main wall 6. First portion 34 has a proximate edge that is joined to front main wall 6 at a third living hinge 36 First portion 34 extends only between intermediate walls 10 and has angled corner walls 38. A second portion 40 of lower end wall 30 is secured to a distal edge of first portion 34 at a fourth living hinge 42 that has two spaced apart hinge portions. In between the two spaced apart hinge portions 42, a stop 44 extending from second portion 40 extends into the body of first portion 34 to define a slot 46 when second portion 40 is folded with respect to first portion 34.

Figure 4:
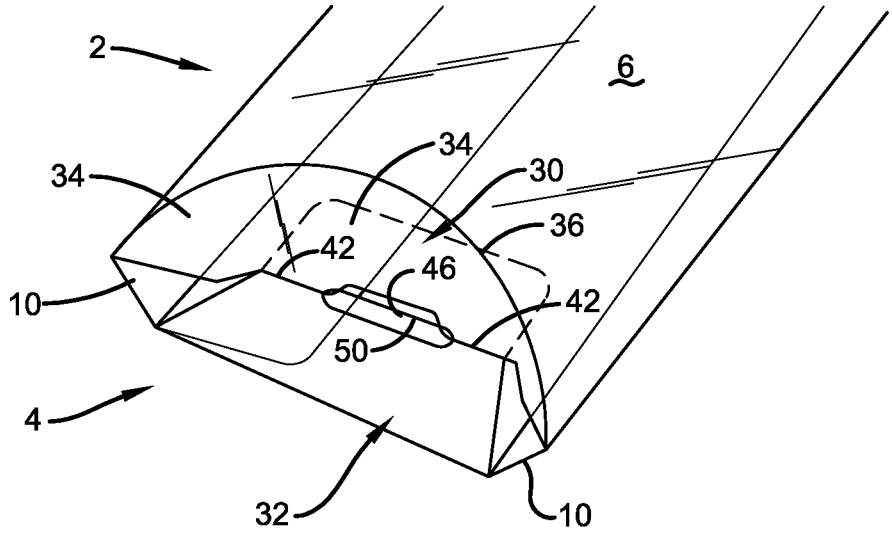
FIG. 4 is a perspective view of the folding locking end wall assembly with the lock tab folded to its locked position.

Locking tab 32 has a locking tongue 50 that is snapped into slot 46 when assembly 4 is assembled as shown in FIG. 4.

Figure 5:
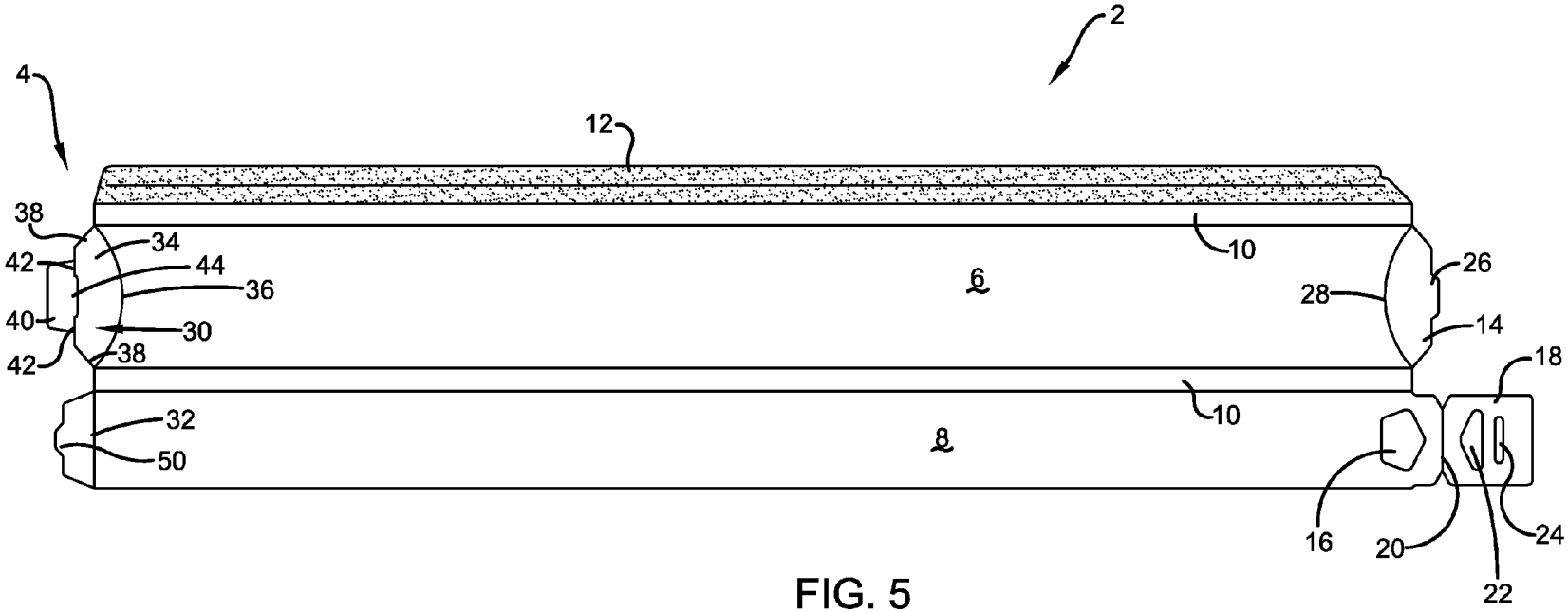
FIG. 5 is a plan view of a blank used to form the exemplary pillow pack with the folding locking end wall assembly.

Pack 2 is formed by cutting or punching material (such as a plastic or a paper material) in the form shown in FIG. 5. Glue flap 12 is coated with glue and folded over a portion of the rear surface of main rear wall 8 to form an open tube. Pack 2 may be shipped to the user in this flat condition. Pack 2 also may be shipped as a flat blank with or without adhesive on glue flap 12 and the end user makes the adhesive connection. In this situation, the end user may add the adhesive or adhesive may be present and protected by a release liner that is removed and recycled.

Figure 2:
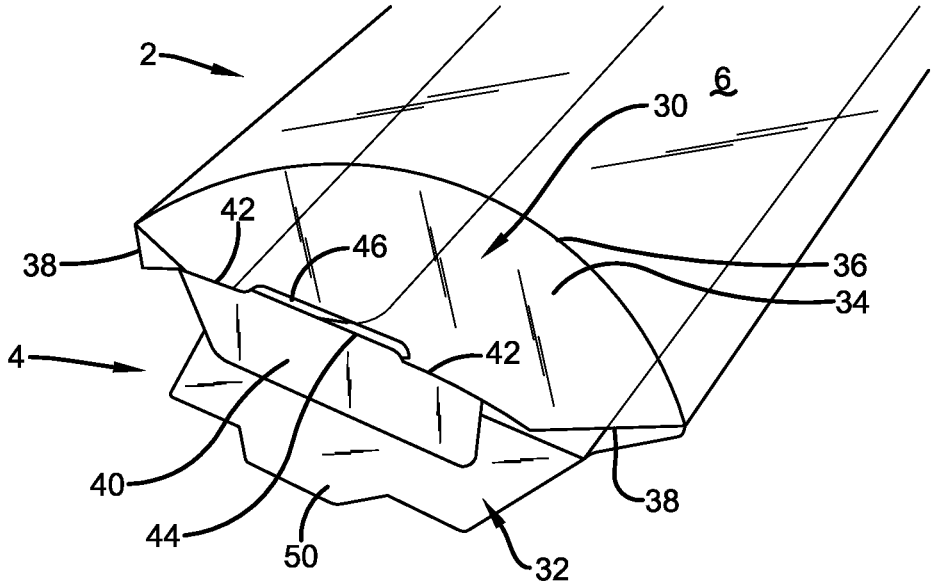
FIG. 2 is a perspective view of the folding locking end wall assembly showing the end wall being folded inwardly toward its assembled position.
Figure 3:
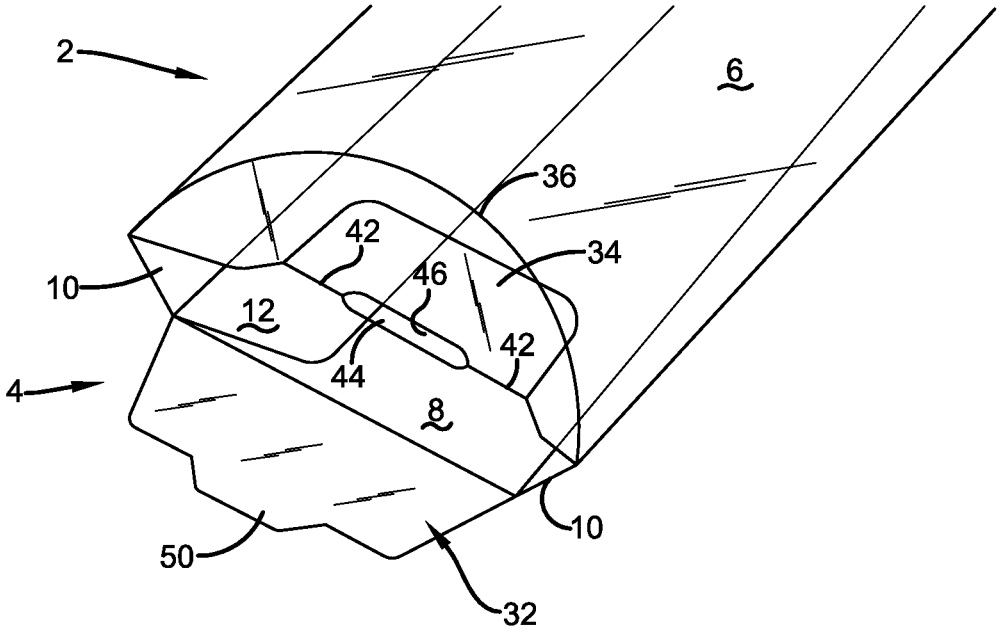
FIG. 3 is a perspective view of the folding locking end wall assembly showing the end wall to its assembled position.

When the user is ready to add merchandise to pack 2, the user assembles folding locking end wall assembly 4 by first folding lower end wall down along hinge 36 while second portion 40 is also folded 90 degrees along hinges 42 to define slot 46 as shown in FIGS. 2 and 3. Second portion 40 is pushed into the tube until first portion 34 is disposed 90 degrees to main rear wall 8 as shown in FIG. 3. This condition helps maintain the curved shape of main front wall 6. Assembly 4 is then locked by folding locking tab 180 degrees until tongue 50 is snapped into slot 46. Stop 44 extends outwardly from first portion 34 so that tongue 50 engages it and snaps into slot 46.

After merchandise is inserted into pack 2, tab 18 is folded over against the extended portion of main rear wall 8 and upper end wall 14 is folded down until tongue 26 is snapped into slot 24 and opening 16. At this time, the upper end of pack 2 is assembled and ready to hang on a display.

Locking tab 32 is disposed substantially parallel to main rear wall 8 and provides a holding force against lower end wall 30 that is substantially opposite the force the merchandise imparts against lower end wall 30 when pack is hanging. Lower end wall is locked in place by the snap fit of tongue 50 in slot 46.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A merchandise display package; comprising:

a front main wall having an upper end and a lower end;

a rear main wall having an upper end and a lower end; the rear main wall having an inner surface;

a folding locking end wall assembly disposed at the lower ends of the main walls; the folding locking end wall assembly including an end wall connected to the front main wall; the end wall defining a slot;

the folding locking end wall assembly also including a lock tab connected to the rear main wall; the lock tab being disposed along the inner surface of the rear main wall with a portion of the lock tab disposed in the slot; and the end wall having a first portion connected to a second portion with a pair of spaced living hinges; the slot being defined between the spaced living hinges; the second portion of the end wall being disposed parallel to the rear main wall inside the package directly between the front main wall and the rear main wall;

wherein the merchandise display package is configured to be hung with the upper end disposed above the lower end with the folding locking end wall assembly configured to receive a majority of the weight of merchandise disposed within the display package.

2. The package of claim 1 wherein the front main wall is curved with respect to the rear main wall.

3. The package of claim 2, wherein the rear main wall is flat.

4. The package of claim 1, wherein the first portion of the end wall is substantially perpendicular to the rear main wall.

5. The package of claim 1, wherein the lock tab is substantially parallel to the rear main wall and disposed outward of the first portion of the end wall such that the majority of the lock tab is not disposed within the package.

6. The package of claim 1, wherein a portion of the second portion of the end wall is disposed between the portion of the lock tab that is disposed in the slot and the rear main wall.

7. The package of claim 1, further comprising a hang tab connected to the upper end of the rear main wall; the hang tab overlaying a portion of the inner surface of the rear main wall;

the rear main wall defining a first opening; and the hang tab defining a second opening that is aligned with the first opening to define a hang opening for the package.

8. The package of claim 1, wherein the main walls and folding locking end wall assembly are configured to be formed from a single flat sheet of material.

9. A merchandise display package; comprising:

a front main wall having an upper end and a lower end;

a rear main wall having an upper end and a lower end; the rear main wall having an inner surface;

a folding locking end wall assembly disposed at the lower ends of the main walls; the folding locking end wall assembly including an end wall connected to the front main wall; the end wall defining a slot;

the folding locking end wall assembly also including a lock tab connected to the rear main wall; the lock tab being disposed along the inner surface of the rear main wall with a portion of the lock tab disposed in the slot;

the end wall having a first portion connected to a second portion with a pair of spaced living hinges; the slot being defined between the spaced living hinges; the second portion of the end wall being disposed parallel to the rear main wall;

a hang tab connected to the upper end of the rear main wall; the hang tab overlaying a portion of the inner surface of the rear main wall;

the rear main wall defining a first opening;

the hang tab defining a second opening that is aligned with the first opening to define a hang opening for the package;

wherein the hang tab defines a slot spaced from the second opening; and the package further comprising:

an upper end wall having a tongue; the tongue of the upper end wall being disposed in the slot of the hang tab.

10. The package of claim 9, wherein the slot of the hang tab overlies the first opening and the tongue of the upper end wall also extending into the first opening to secure the position of the upper end wall.

11. A merchandise display package; comprising:

a flat rear main wall having an upper end and a lower end; the flat rear main wall having an inner surface;

a curved front main wall having an upper end and a lower end;

first and second intermediate walls disposed between the curved front main wall and the flat rear main wall;

a folding locking end wall assembly disposed at the lower ends of the main walls; the folding locking end wall assembly including an end wall connected to the front main wall; the end wall defining a slot;

the end wall having a first portion connected to a second portion with a pair of spaced living hinges; the slot being defined between the spaced living hinges; the second portion of the end wall being disposed inside the package directly between the flat main rear wall and the curved front main wall;

the folding locking end wall assembly also including a lock tab connected to the rear main wall; the lock tab being disposed along the inner surface of the rear main wall with a portion of the lock tab disposed in the slot; and the majority of the lock tab being disposed outward of the end wall such that the majority of the lock tab is not disposed within the package.

12. The package of claim 11, wherein the first portion of the end wall is substantially perpendicular to the flat rear main wall.

13. The package of claim 11, further comprising a hang tab connected to the upper end of the rear main wall; the hang tab overlaying a portion of the inner surface of the rear main wall;

the rear main wall defining a first opening; and the hang tab defining a second opening that is aligned with the first opening to define a hang opening for the package.

14. A merchandise display package; comprising:

a flat rear main wall having an upper end and a lower end; the flat rear main wall having an inner surface;

a curved front main wall having an upper end and a lower end;

first and second intermediate walls disposed between the curved front main wall and the flat rear main wall;

a folding locking end wall assembly disposed at the lower ends of the main walls; the folding locking end wall assembly including an end wall connected to the front main wall; the end wall defining a slot;

the folding locking end wall assembly also including a lock tab connected to the rear main wall; the lock tab being disposed along the inner surface of the rear main wall with a portion of the lock tab disposed in the slot;

the majority of the lock tab being disposed outward of the end wall such that the majority of the lock tab is not disposed within the package;

a hang tab connected to the upper end of the rear main wall; the hang tab overlaying a portion of the inner surface of the rear main wall;

the rear main wall defining a first opening;

the hang tab defining a second opening that is aligned with the first opening to define a hang opening for the package;

wherein the hang tab defines a slot spaced from the second opening; and the package further comprising:

an upper end wall having a tongue; the tongue of the upper end wall being disposed in the slot of the hang tab.

15. The package of claim 14, wherein the slot of the hang tab overlies the first opening and the tongue of the upper end wall also extending into the first opening to secure the position of the upper end wall.

16. The package of claim 15, wherein the main walls and folding locking end wall assembly are configured to be formed from a single flat sheet of material.

17. The package of claim 15, wherein the merchandise display package is configured to be hung with the upper end disposed above the lower end with the folding locking end wall assembly configured to receive a majority of the weight of merchandise disposed within the display package.

* * * * *